US006334484B1

(12) United States Patent
Kandel

(10) Patent No.: US 6,334,484 B1
(45) Date of Patent: Jan. 1, 2002

(54) MULTI-PASS HEAT EXCHANGER

(75) Inventor: Heinz Georg Kandel, Wetter (DE)

(73) Assignee: Aventis Behring GmbH, Marburg (DE)

( * ) Notice: Subject to any disclaimer, the term of this patent is extended or adjusted under 35 U.S.C. 154(b) by 0 days.

(21) Appl. No.: 09/294,896

(22) Filed: Apr. 20, 1999

(30) Foreign Application Priority Data

Apr. 21, 1998 (DE) ..... 198 17 659

(51) Int. Cl.[7] ..... F28F 9/02
(52) U.S. Cl. ..... 165/158; 165/DIG. 428
(58) Field of Search ..... 165/158, 174, 165/DIG. 428

(56) References Cited

U.S. PATENT DOCUMENTS

| | | | | | |
|---|---|---|---|---|---|
| 2,900,173 | A | * | 8/1959 | Pickford | 165/DIG. 428 |
| 4,972,903 | A | | 11/1990 | Kwok | 165/158 |
| 5,284,203 | A | * | 2/1994 | Dauvergne | 165/174 |

FOREIGN PATENT DOCUMENTS

| | | | | | |
|---|---|---|---|---|---|
| DE | 3126422 | * | 1/1983 | | 165/158 |
| DE | 44 18 285 A1 | | 1/1995 | | |
| FR | 362883 | * | 7/1906 | | 165/158 |
| FR | 2 476 826 | | 8/1981 | | |
| FR | 2 491 610 | | 4/1982 | | |
| FR | 2 665 757 | | 2/1992 | | |
| GB | 191175 | * | 1/1923 | | 165/158 |

* cited by examiner

*Primary Examiner*—Allen Flanigan
(74) *Attorney, Agent, or Firm*—Finnegan, Henderson, Farabow, Garrett and Dunner, L.L.P.

(57) ABSTRACT

The present invention is a multi-pass heat exchanger for use with sterile liquids. The multi-pass heat exchanger includes a tube body and a bonnet, the bonnet being connected to a tubesheet of the tube body. Arranged in the bonnet and dividing the bonnet into at least inlet and outlet chambers is at least one web for directing the liquid conveyed into the bonnet. The web is connected to the bonnet. A gap is provided between the web and the tubesheet, allowing fluid exchange between the bonnet chambers. In this way, a leakage flow, which flushes the gap clear to prevent any type of bacterial deposit or contamination, can flow between the chambers formed by the web. Because the risk of contamination is eliminated, the heat exchanger can be used for the cooling of liquid present in the ultra-pure state, in particular of ultra-pure water.

13 Claims, 1 Drawing Sheet

MULTI-PASS HEAT EXCHANGER

BACKGROUND OF THE INVENTION

1. Field of the Invention

The invention relates to a multi-pass heat exchanger having a tube body and a bonnet, which is connected to the tubesheet of the tube body and in which at least one web for directing the liquid conveyed into the bonnet is arranged, the web being connected to the bonnet.

2. Description of the Related Art

Multi-pass heat exchangers are used in the chemical industry. In a 2-pass heat exchanger a web separates the liquid conveyed into the bonnet from the liquid conveyed out of the bonnet. By fitting a plurality of webs into the bonnet of a 4 or 6-pass heat exchanger, the liquid flow is deflected repeatedly in the bonnet and forced to pass the heat exchanger repeatedly. As a result, high flow velocities are achieved in the tubes, and good heat transfer is obtained.

For use with liquids present in the ultra-pure form, in particular for use in ultra-pure-water systems (WFI=Water for Injection), these designs cannot be used, since seals are required to seal off the webs, and these seals involve the risk of bacterial deposit and contamination. For this reason, heat exchangers having only one passage and twin tubesheets have been used for ultra-pure-water systems. The flow velocities in the tubes of such heat exchangers are correspondingly low and poor coefficients of heat transfer are obtained. The consequence is that these heat exchangers, although satisfactory from the point of view of sterility, require a large overall length in order to achieve satisfactory cooling of the liquid. Heat exchangers for sterile liquids which measure several meters in overall length are not uncommon.

SUMMARY OF THE INVENTION

Against this background, the object of the present invention is to develop a multi-pass heat exchanger that can be used for cooling liquid present in the ultra-pure state, in particular ultra-pure water.

This object is achieved by modifying a multi-pass heat exchanger to eliminate the seal between the web and tubesheet and to form a gap between the web and the tubesheet.

According to the present invention, a multi-pass heat exchanger for cooling ultra-pure liquids is provided, the multi-pass heat exchanger including a tube body having a tubesheet, a bonnet connected to the tubesheet, and at least one web for directing the liquid conveyed into the bonnet, a portion of the web being secured to the bonnet and dividing the bonnet into at least two chambers, and wherein the web is not secured to the tubesheet.

According to another aspect of the present invention, a multi-pass heat exchanger is provided, the multi-pass heat exchanger including a tube body having a tubesheet, a bonnet connected to the tubesheet, and at least one web for directing the liquid conveyed into the bonnet, a portion of the web being secured to the bonnet and dividing the bonnet into at least two chambers, wherein there is a gap between the web and the tubesheet.

Additional features and advantages of the invention will be set forth in the description which follows, and in part will be apparent from the description, or may be learned by practice of the invention. The objects and other advantages of the invention will be realized and attained by the method and apparatus particularly pointed out in the written description and claims as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute a part of the specification, illustrate an embodiment of the invention, and together with the description serve to explain the principles of the invention. In the figures.

DETAILED DESCRIPTION OF THE INVENTION

Examples of the present preferred embodiments of the invention are illustrated in the accompanying drawings. Wherever possible, similar reference numbers will be used throughout the drawings to refer to similar parts.

Figure 1:
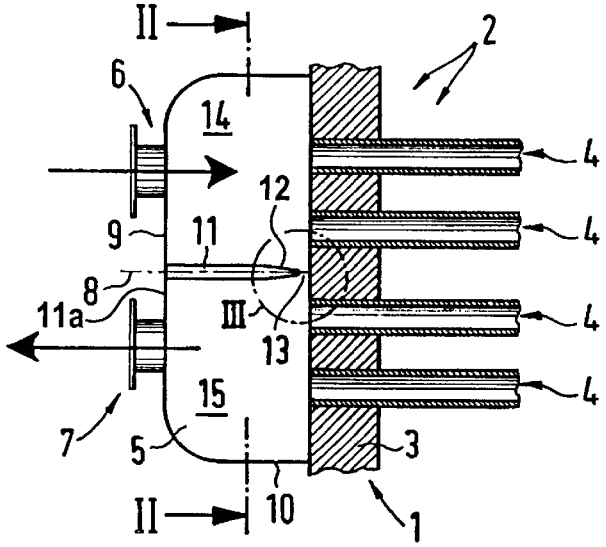
FIG. 1 is a longitudinal section through the region of the bonnet of a 2-pass heat exchanger of the present invention.
Figure 2:
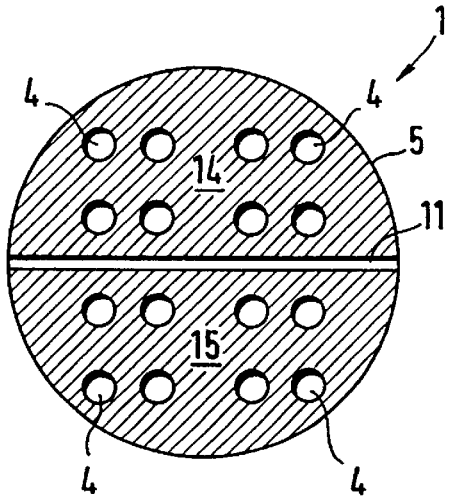
FIG. 2 is a cross-sectional view taken along line II—II of FIG. 1.

According to the invention, a 2-pass heat exchanger is provided for cooling sterile liquids. As embodied herein and shown in FIGS. 1 and 2, a 2-pass heat exchanger is generally designated by the reference numeral 1. The 2-pass heat exchanger 1 includes a tube body 2 having a tubesheet 3 and sixteen tubes 4, which are held in a sealed off manner in corresponding holes of the tubesheet 3. A bonnet 5 connected to the tubesheet 3 covers the tube region of the tube body 2 and is provided with an inlet nozzle 6 and an outlet nozzle 7 for conveying the liquid, for example ultra-pure water, to be cooled in the heat exchanger 1. The direction of flow of the liquid to be cooled is illustrated in FIG. 1 by means of the thick arrows. Apart from the two nozzles 6 and 7, the bonnet is of rotationally symmetrical design. In the region of the plane of symmetry 8 of the bonnet 5, a thin-walled web 11, which ends at a distance from the tubesheet 3, is provided. Web 11 is connected to the bonnet 5 at its top face 9 and its side face 10. Thus, web 11 has a secured end 11*a* connected to the top face 9 of bonnet 5, and an unsecured or free end 12 facing but not connected to the tubesheet 3.

In a preferred embodiment of the present invention, free end 12 of web 11 is pointed. Due to this shape, which is made especially favorable from the fluidic point of view, deposits cannot occur in the region of the web end facing the tubesheet.

Web 11 does not subdivide the bonnet into completely separate chambers, but is produced in its length in such a way that a distance, gap 13, remains between web and tubesheet. A leakage flow through gap 13 is thereby obtained, and this leakage flow serves to flush the gap clear to prevent deposits or contamination.

Figure 3:
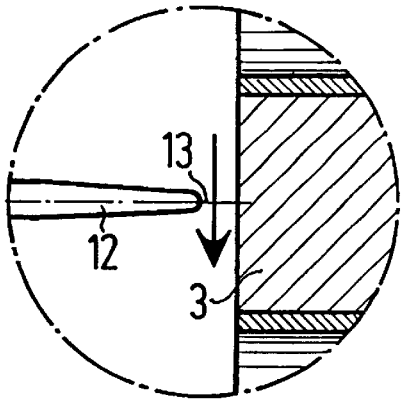
FIG. 3 is a detailed view of area III of FIG. 1.

As can be seen in FIG. 3, a gap 13, having a thickness of 0.2 mm for example, is formed between the pointed end 12 of the web and the tubesheet 3. The liquid to be cooled therefore not only flows through the tubes 4 of the heat exchanger 1 but, as illustrated in FIG. 3 by the thick arrow, a leakage flow passes directly from the inlet chamber 14 of the bonnet 5 to its outlet chamber 15. The width of the gap is to be optimized to the effect that a sufficient leakage flow flows through the gap during operation of the heat exchanger in order to flush the gap clear. As a rule, it is sufficient to select this gap to be less than 1 mm. However, it is possible to use a gap of larger dimensions.

Figure 4:
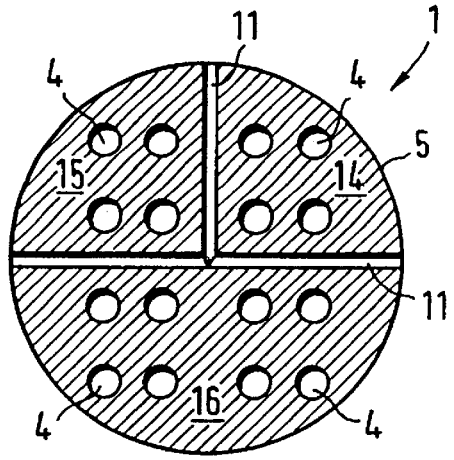
FIG. 4 is a cross-sectional view through the region of the bonnet of a 4-pass heat exchanger according to a second embodiment of the present invention.

Depending on the type of multi-pass heat exchanger to be designed, a plurality of webs may be provided. A 4-pass heat exchanger has, for example, two webs. As seen in FIG. 4, the webs are arranged in particular in a T-shape, so that the bonnet is subdivided into three chambers. If a 6-pass heat exchanger were to be provided, four chambers would result. The webs are preferably expediently arranged at an angle of 90° to one another.

A design of the bonnet 5 in the case of a 4-pass heat exchanger is shown in FIG. 4. In the embodiment according to FIG. 4, two webs 11 or web regions are provided. The webs 11 are arranged like a T, one web 11 having a length which corresponds to the diameter of the bonnet 5, whereas the length of the other web 11 corresponds to the radius of the bonnet 5. With appropriate change to the arrangement of inlet nozzle 6 and outlet nozzle 7, which are allocated to the chambers 14 and 15, the liquid to be cooled enters the inlet chamber 14, which is arranged in the region of the first quarter of the bonnet 5. It then flows, apart from the leakage flow, through the tubes 4 allocated to this chamber 14 into the heat exchanger 1 and leaves the tube body 2 in the region of the second quarter of the bonnet; from there the liquid in the chamber 16 is deflected to the tubes 4 arranged in the region of the third quarter of the bonnet 5. It enters the tubes 4 and leaves these tubes 4 in the region of the outlet chamber 15, which is allocated to the fourth quarter of the bonnet 5. The leakage flow described above is obtained in the region of the T-shaped webs 11, which in accordance with the representation of FIG. 3, form a gap 13 relative to the tubesheet 3. Thus, each web 11 has a gap between its free end 12 and tubesheet 3.

In an alternative embodiment, it would be possible to provide a multi-pass heat exchanger having at least six passages. In doing so, it would be possible to use either four webs having a length corresponding to the radius of bonnet 5, 2 webs corresponding to the diameter of bonnet 5 or a combination of the two which would result in at least 4 chambers in bonnet 5.

The leakage flow in the present invention certainly leads to thermic losses, since it does not flow through the heat exchanger and thus is not subjected to any cooling. A mixed temperature occurs between the leakage flow and the cooled flow leaving the heat exchanger. Despite these losses, the advantage realized by using the present invention of a compact, short heat exchanger working in a sterile manner is considerable, since it conforms to GMP.

It will be apparent to those skilled in the art that various modifications and variations can be made in the present invention without departing from the spirit or scope of the invention. Thus, it is intended that the present invention covers all modifications and variations of this invention that come within the scope of the appended claims and their equivalents.

What is claimed is:

1. A multi-pass heat exchanger comprising:

a tube body having a tubesheet;

a bonnet connected to the tubesheet, the bonnet including an inlet for conveying liquid into the bonnet; and at least one web for directing the liquid conveyed into the bonnet, a portion of the web being secured to the bonnet and dividing the bonnet into at least two chambers, wherein the web is not secured to the tubesheet, and wherein the web has a secured end and a free end, the free end of the web being pointed.

2. The multi-pass heat exchanger of claim 1, wherein there is a gap between the web and the tubesheet.

3. The multi-pass heat exchanger of claim 1, wherein there is a gap between the free end of the web and the tubesheet.

4. The multi-pass heat exchanger of claim 1, wherein at least two webs for subdividing the bonnet into chambers are provided.

5. The multi-pass heat exchanger of claim 1, wherein at least two webs are provided to subdivide the bonnet into chambers, each web having a secured end and a free end, and wherein there is a gap between the free end of each web and the tubesheet.

6. A multi-pass heat exchanger comprising:

a tube body having a tubesheet;

a bonnet connected to the tubesheet, the bonnet including an inlet for conveying liquid into the bonnet; and at least two webs for directing the liquid conveyed into the bonnet, a portion of each web being secured to the bonnet and dividing the bonnet into chambers, wherein each web is not secured to the tubesheet, each web having a secured end and a free pointed end, and wherein there is a gap between the free end of each web and the tubesheet.

7. The multi-pass heat exchanger of claim 1, wherein at least two webs for subdividing the bonnet into chambers are provided and the webs are arranged at an angle of 90° relative to one another.

8. The multi-pass heat exchanger of claim 1, wherein at least two webs are provided to subdivide the bonnet into chambers, each web having a secured end and a free end, wherein there is a gap between the free end of each web and the tubesheet, and wherein the webs are arranged at an angle of 90° relative to one another.

9. A multi-pass heat exchanger comprising:

a tube body having a tubesheet;

a bonnet connected to the tubesheet, the bonnet including an inlet for conveying liquid into the bonnet; and at least one web for directing the liquid conveyed into the bonnet, a portion of the web being secured to the bonnet and dividing the bonnet into at least two chambers, wherein the web has a secured end and a free end, the free end of the web being pointed, and wherein there is a gap between the web and the tubesheet.

10. The multi-pass heat exchanger of claim 9, wherein at least two webs are provided to subdivide the bonnet into chambers.

11. The multi-pass heat exchanger of claim 9, wherein at least two webs are provided to subdivide the bonnet into chambers, each web having a secured end and a free end, and wherein there is a gap between the free end of each web and the tubesheet.

12. The multi-pass heat exchanger of claim 9, wherein at least two webs are provided to subdivide the bonnet into chambers, and wherein the webs are arranged at an angle of 90° relative to one another.

13. The multi-pass heat exchanger of claim 9, wherein at least two webs are provided to subdivide the bonnet into chambers, each web having a secured end and a free end, wherein there is a gap between the free end of each web and the tubesheet, and wherein the webs are arranged at an angle of 90° relative to one another.

* * * * *